US006216562B1

(12) United States Patent
Hsieh

(10) Patent No.: US 6,216,562 B1
(45) Date of Patent: Apr. 17, 2001

(54) WRENCH

(76) Inventor: Chih-Ching Hsieh, No. 64, Lane 107, Liang Tsun Rd., Fong Yuan City, Taichung Hsien (TW)

( * ) Notice: Subject to any disclaimer, the term of this patent is extended or adjusted under 35 U.S.C. 154(b) by 0 days.

(21) Appl. No.: 09/526,889

(22) Filed: Mar. 16, 2000

(51) Int. Cl.[7] ..... B25B 17/00
(52) U.S. Cl. ..... 81/57.29; 81/57.46
(58) Field of Search ..... 81/57.29, 57.13, 81/57.28, 57.45, 57.46

(56) References Cited

U.S. PATENT DOCUMENTS

| | | | | |
|---|---|---|---|---|
| 1,698,618 | * | 1/1929 | Bigelow | 81/57.46 |
| 2,477,528 | * | 7/1949 | Shrader | 81/57.29 |
| 2,703,030 | * | 3/1955 | Marvin | 81/57.29 |
| 3,696,694 | * | 10/1972 | Boro | 81/57.27 |
| 3,707,893 | * | 1/1973 | Hofman | 81/58.1 |
| 4,258,594 | * | 3/1981 | Welch | 81/57.29 |
| 4,685,848 | * | 8/1987 | Langer | 411/402 |
| 4,970,918 | * | 11/1990 | Brewer et al. | 81/57.29 |
| 5,090,395 | * | 2/1992 | Gannon | 124/25.6 |
| 6,009,776 | * | 1/2000 | Warren | 81/57.29 |

* cited by examiner

*Primary Examiner*—James G. Smith
*Assistant Examiner*—Hadi Shakeri
(74) *Attorney, Agent, or Firm*—Varndell & Varndell, PLLC

(57) ABSTRACT

A wrench, which includes a hollow three-way (or two-way) casing, a plurality of coupling shafts respectively mounted in the ends of the casing for holding a respective tool accessory, and a transmission mechanism coupled between the coupling shafts for enabling the coupling shafts to be rotated synchronously, wherein the transmission mechanism includes a plurality of transmission members respectively coupled to the coupling shafts inside the casing and meshed with one another, and a plurality of compression springs respectively mounted in the coupling shafts to force the transmission members into engagement with one another, the transmission members each having a rectangular shank at one end inserted into a rectangular coupling hole on the respective coupling shaft and supported on the corresponding compression spring, and a bevel gear at an opposite end meshed with the bevel gear at the transmission member in an adjacent coupling shaft.

4 Claims, 5 Drawing Sheets

WRENCH

BACKGROUND AND SUMMARY OF THE INVENTION

The present invention relates to a wrench, which comprises a hollow casing having multiple ends, a plurality of coupling shafts respectively mounted in the ends of the casing to hold a respective tool accessory for synchronous rotation, and a transmission mechanism coupled between the coupling shafts for enabling the coupling shafts to be synchronously rotated.

Various wrenches have been dislcosed, and have appeared on the market. FIG. 1 shows a wrench, which comprises a hollow two-way casing, two coupling shafts respectively mounted in the two ends of the casing for holding a respective tool accessory. The coupling shafts each have an inner end meshed together by means of a respective bevel gear for synchronous rotation. This structure of wrench is still not satisfactory in function. Because lubricating grease can not be applied to the bevel gears, the teeth of the bevel gears wear quickly with use. When the teeth of the bevel gears start to wear, driving power can not be positively transmitted from one coupling shaft to the other.

The present invention provides a wrench, which eliminates the aforesaid drawbacks. According to one aspect of the present invention, the wrench comprises a hollow three-way (or two-way) casing, a plurality of coupling shafts respectively mounted in the ends of the casing for holding a respective tool accessory, and a transmission mechanism coupled between the coupling shafts for enabling the coupling shafts to be rotated synchronously. The transmission mechanism comprises a plurality of transmission members respectively coupled to the coupling shafts inside the casing and meshed with one another, and a plurality of compression springs respectively mounted in the coupling shafts to force the transmission members into engagement with one another. The transmission members each have a rectangular shank at one end inserted into a rectangular coupling hole on the respective coupling shaft and supported on the corresponding compression spring, and a bevel gear at an opposite end meshed with the bevel gear at the trasmission member in an adjacent coupling shaft. According to another aspect of the present invention, lubricating grease is applied to the bevel gears of the transmission members.

DETAILED DESCRIPTION OF THE PREFERRED EMBODIMENT

Figure 3:
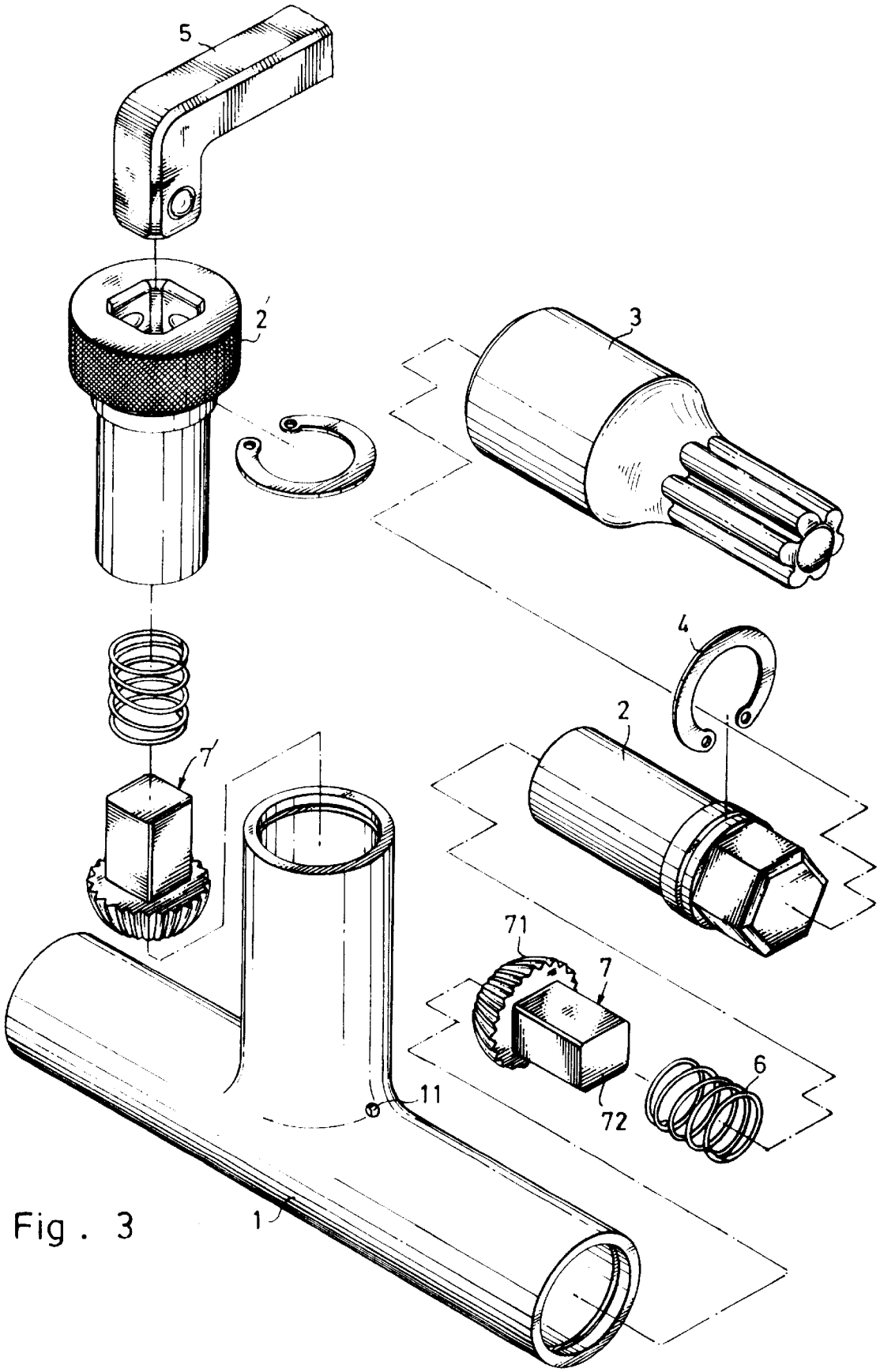
FIG. 3 is an exploded view of a wrench according to a second embodiment of the present invention.
Figure 4:
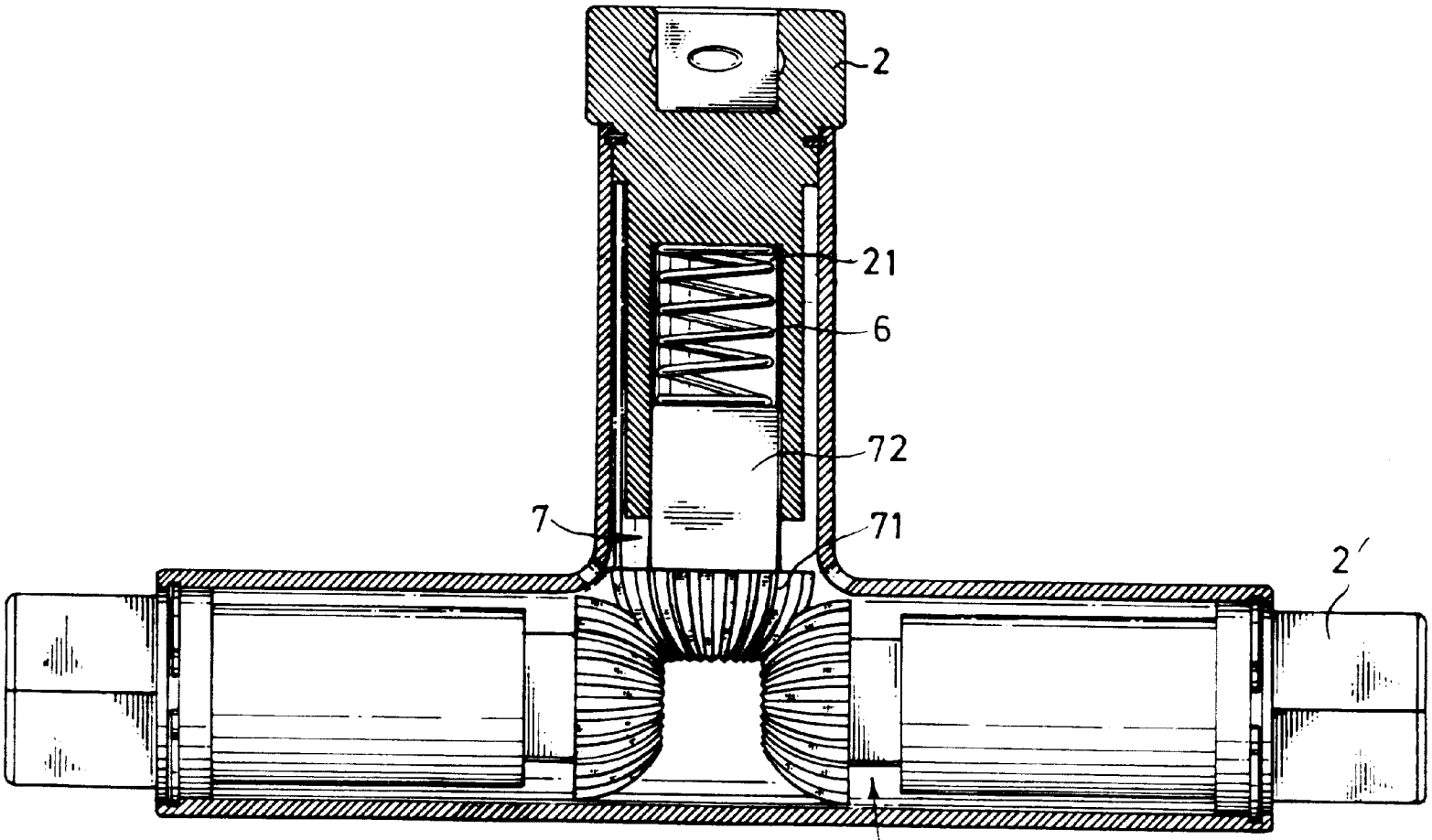
FIG. 4 is a sectional assembly view of the wrench shown in FIG. 3.

Referring to FIGS. from 2 through 5, a wrench is shown comprised of a hollow casing 1, and a plurality of coupling shafts 2 and 2' respectively mounted in the casing 1. According to the embodiment shown in FIG. 2, the casing 1 is a hollow angle bar, and the number of the coupling shafts 2 and 2'. According to the embodiment shown in FIGS. 3 and 4, the casing 1 is a hollow T-bar, and the number of the coupling shafts 2 and 2'. The coupling shafts 2 and 2' are respectively mounted in the ends of the casing 1, and secured in place by a respective C-shaped clamp 4 for holding a socket 3 or spanner 5. The coupling shafts 2 and 2' each comprise a rectangular coupling hole 21 axially extended at one end inside the casing 1, which receives a compression spring 6 and a transmission member 7 or 7'. The transmission member 7 or 7' comprises a rectangular shank 72 inserted into the rectangular coupling hole 21 on the corresponding coupling shafts 2 or 2', and a bevel gear 71 formed integral with one end of the rectangular shank 72 and disposed outside the corresponding coupling shaft 2 or 2' within the casing 1. When assembled, the bevel gear 71 or the transmission member 7 or 7' at one coupling shafts 2 or 2' is meshed with the bevel gear 71 of the transmission member 7 or 7' at another coupling shafts 2 or 2'. Because the transmission members 7 and 7' are supported on the respective compression springs 6, the transmission members 7 and 7' are respectively forced outwards from the respective coupling shafts 2 and 2', keeping the bevel gears 71 of the transmission members 7 and 7' in positive engagement with one another. Further, the casing 1 comprises at least one lubricating hole 11 through which lubricating grease is applied to the bevel gears 71 of the transmission members 7 and 7'.

Figure 1:
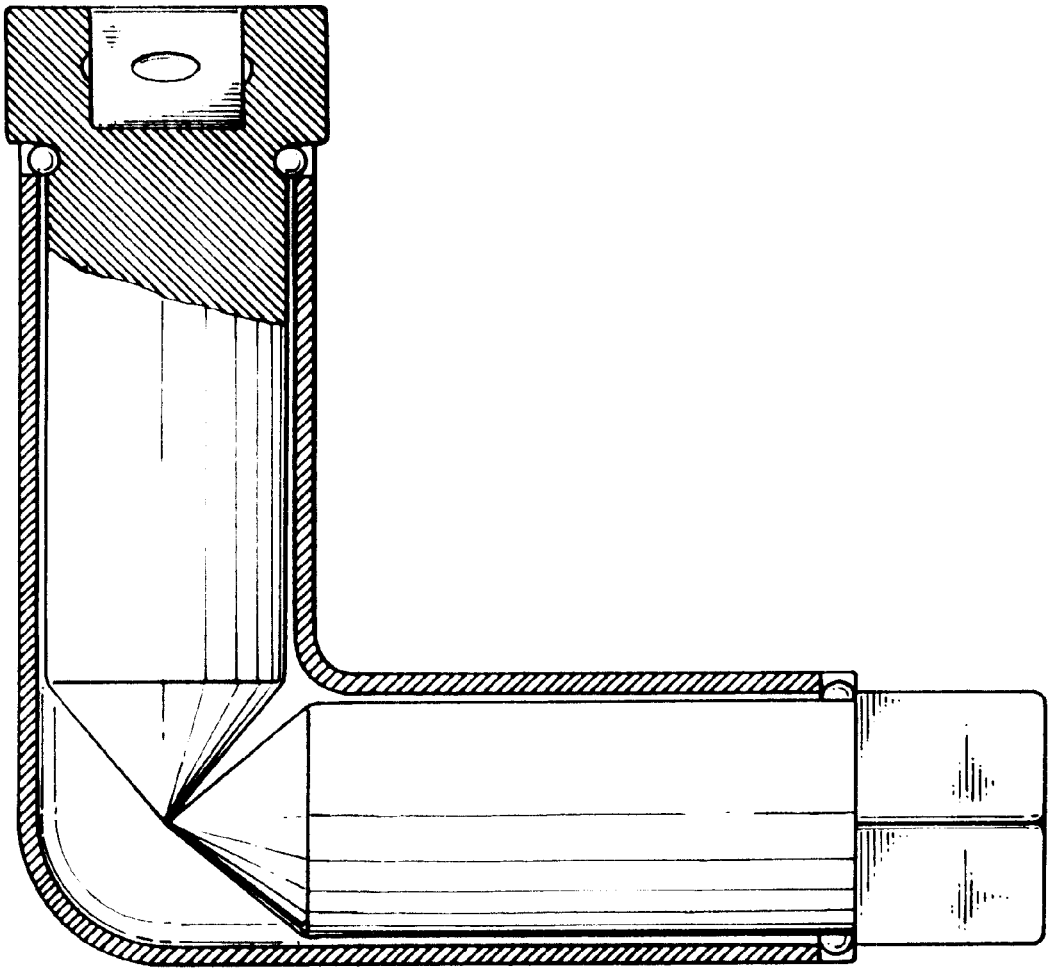
Fig . 1 PRIOR ART
FIG. 1 is a sectional view of a wrench according to the prior art.
Figure 2:
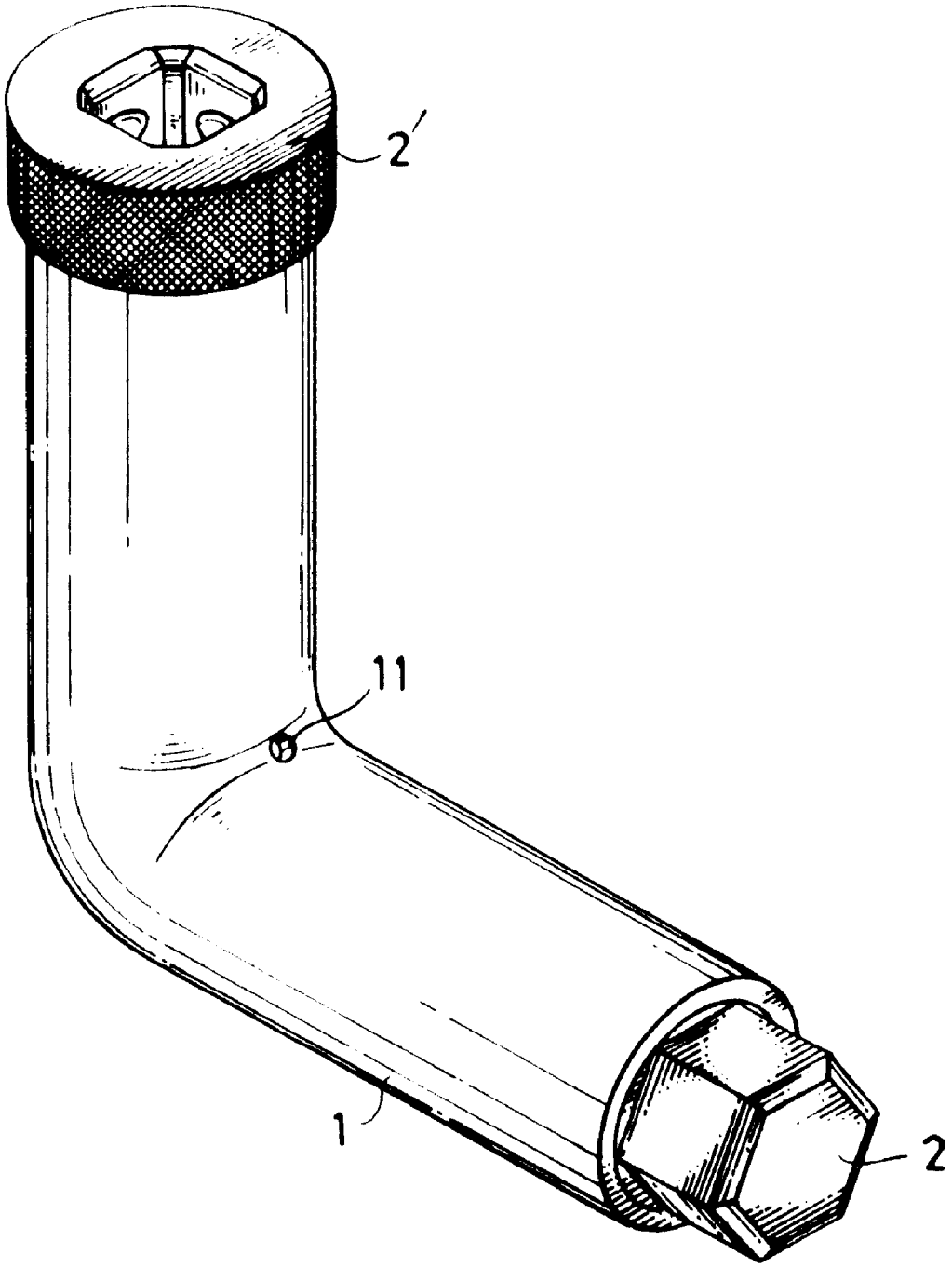
FIG. 2 is an elevational view of a wrench according to a first embodiment of the present invention.
Figure 5:
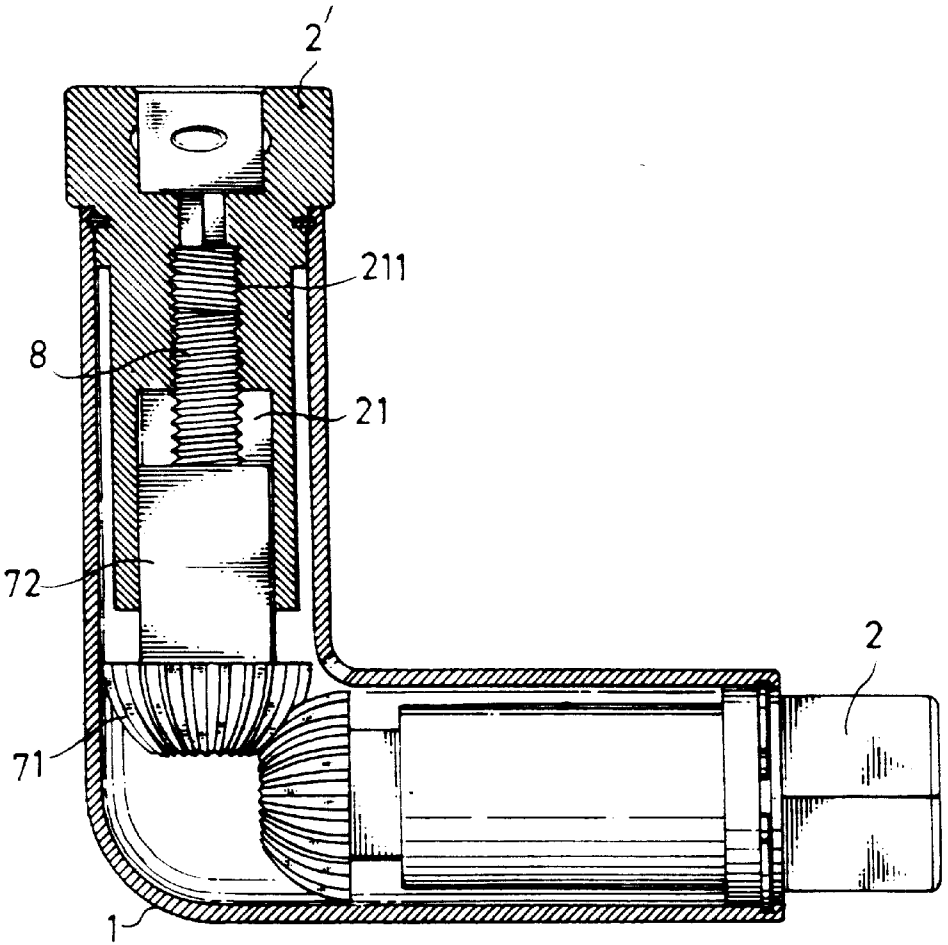
FIG. 5 is a sectional view of the wrench shown in FIG. 2.

In the embodiment shown in FIGS. 2 and 5, each coupling shafts 2 or 2' comprises a screw hole 211 axially extended from the inner end of the respective rectangular coupling hole 21, and screw rods 8 are used inserted of the aforesaid compression springs 6. The screw rods 8 each have one end threaded into the screw hole 211 in the respective coupling shaft 2 or 2', and an opposite end suspended in the rectangular coupling hole 21 in the respective coupling shaft 2 or 2' and stopped against the rectangular shank 72 of the corresponding transmission member 7 or 7'. By means of adjusting the screw rods 8 in the respective screw holes 211, the bevel gears 71 of the transmission members 7 and 7' are maintained in positive engagement with each other.

What is claimed is:

1. A wrench comprising a hollow casing, said casing comprising a plurality of outlets disposed in communication with one another, a plurality of coupling shafts respectively mounted in the outlets in said casing, said coupling shafts each having an outer end disposed outside said casing for holding a respective tool accessory, and a transmission mechanism coupled between said coupling shafts for enabling said coupling shafts to be rotated synchronously, wherein said coupling shafts each comprise a rectangular coupling hole axially disposed at an inner end and coupled to said transmission mechanism, said transmission mechanism comprises a plurality of transmission members respectively coupled to said coupling shafts inside said casing and meshed with one another, and a plurality of adjustment elements respectively mounted in the coupling holes in said coupling shafts to force said plurality of transmissions members transmission members into engagement with one another, said each comprising a rectangular shank inserted into the rectangular coupling hole on the respective coupling shaft and supported on the respective adjustment element, and a bevel gear formed integral with one end of said rectangular shank and meshed with the bevel gear at the transmission member in an adjacent coupling shaft.

2. The wrench of claim 1 wherein said casing comprising at least one lubricating hole through which a lubricating grease is applied to the bevel gear at each transmission member of said transmission mechanism.

3. The wrench of claim 1 wherein said adjustment elements of said transmission mechanism are compression springs respectively mounted in the coupling hole in each coupling shaft and stopped against the rectangular shank of the corresponding transmission member to push the corresponding transmission member outwards from the respective coupling shaft.

4. The wrench of claim 1 wherein said adjustment elements of said transmission mechanism are adjustment screw rods, said adjustment screw rods each one end threaded into a screw hole in the rectangular coupling hole in the corresponding coupling shaft, and an opposite end stopped against the rectangular shaft of the corresponding transmission member.

* * * * *